US006773348B2

(12) United States Patent
Stockdale

(10) Patent No.: US 6,773,348 B2
(45) **Date of Patent: *Aug. 10, 2004**

(54) BATTERY POWERED GAMING MACHINE SECURITY MONITORING SYSTEM

(75) Inventor: James W. Stockdale, Clio, CA (US)

(73) Assignee: IGT, Reno, NV (US)

( * ) Notice: Subject to any disclaimer, the term of this patent is extended or adjusted under 35 U.S.C. 154(b) by 186 days.

This patent is subject to a terminal disclaimer.

(21) Appl. No.: 09/974,156

(22) Filed: Oct. 9, 2001

(65) Prior Publication Data

US 2002/0032051 A1 Mar. 14, 2002

Related U.S. Application Data

(62) Division of application No. 09/477,762, filed on Jan. 4, 2000.

(51) Int. Cl.[7] ..... A63F 9/24
(52) U.S. Cl. ..... 463/29
(58) Field of Search ..... 463/1, 13, 17–20, 463/29, 47, 46; 340/855.4, 545.1, 545.2, 545.3, 555, 545.6, 556, 547, 548, 549, 825.2; 194/350–351, 206–207; 219/721–722; 235/381–382; 273/143 R, 148 R, 138.1; 236/8

(56) References Cited

U.S. PATENT DOCUMENTS

| | | | | | |
|---|---|---|---|---|---|
| 3,713,142 | A | * | 1/1973 | Getchell | 340/505 |
| 4,583,082 | A | * | 4/1986 | Naylor | 340/545.3 |
| 5,534,849 | A | | 7/1996 | McDonald et al. | 340/517 |
| 5,643,086 | A | | 7/1997 | Alcorn et al. | 463/29 |
| 5,761,647 | A | | 6/1998 | Boushy | 705/10 |
| 5,912,619 | A | * | 6/1999 | Vogt | 340/545.1 |
| 5,923,249 | A | * | 7/1999 | Muir | 340/545.1 |
| 6,104,815 | A | | 8/2000 | Alcorn et al. | 380/251 |
| 6,106,396 | A | | 8/2000 | Alcorn et al. | 463/29 |
| 6,149,522 | A | | 11/2000 | Alcorn et al. | 463/29 |
| 6,575,833 | B1 | * | 6/2003 | Stockdale | 463/29 |

FOREIGN PATENT DOCUMENTS

| | | | |
|---|---|---|---|
| DE | 3601157 | A1 | 7/1987 |
| DE | 3802601 | A1 | 8/1989 |
| DE | 9101529.4 | | 5/1991 |
| DE | 4140451 | A1 | 6/1993 |
| DE | 29713455 | U1 | 11/1997 |
| EP | 0436258 | A2 | 7/1991 |

OTHER PUBLICATIONS

Schematic Illustration and associated specifications describing a security monitoring system employed in some gaming machines, available from International Game Technology prior to Dec. 1999.

* cited by examiner

*Primary Examiner*—Kim Nguyen
(74) *Attorney, Agent, or Firm*—Beyer, Weaver & Thomas LLP

(57) ABSTRACT

A disclosed battery powered security monitoring system provides a security system that monitors validation signals detected by a sensor at least twice during each oscillation of the validation signal. This technique may be applied both while the main power to the gaming machine is on and while a backup power source (e.g., a battery) is on. Preferably, the security system of this invention employs a custom integrated circuit (e.g., an end-user programmed complex programmable logic device) to perform some the security functions such as supplying the validation signal to the sensor and comparing a sensor output signal to the validation signal to determine whether access to a gaming machine device has occurred.

27 Claims, 9 Drawing Sheets

| Address | Bit | Direction | Description |
|---|---|---|---|
| $0 | | | **DETECT/CONTROL REGISTER** |
| | 7 | RO | **VALIDATION PULSE LEVEL** |
| | 6-0 | RO | **DETECTION INPUTS**. (Power Mode=1) Compared to validation pulse when power is on. |
| | 6-0 | RO | **DETECTION REGISTER**. (Power Mode=0) 1 in register when event occurred during power off, else 0 in register |
| | X | WO | **Control Register.** A write to this address will clear the detect register, Power Latch bit and POWERFAIL bit |
| $1 | | | **POWER STATUS REGISTER** |
| | 7 | RO | **VALIDATION PULSE LEVEL** |
| | 6 | RO | **DETECTION INPUTS**. (Power Mode=1) Compared to validation pulse when power is on. |
| | 6 | RO | **DETECTION REGISTER**. (Power Mode=0) 1 in register when door was opened during power off, else 0 in register |
| | 5 | RO | **POWERFAIL**. Real time indication of a power failure input from the power supply. |
| | 4 | RO | **POWER MODE**. 1=real time detect with power on, 0= latch mode with power off |
| | 3 | RO | **TTBATLOW**. Status of Battery. 0=Battery voltage low |
| | 2 | RO | **SRAMBATLOW**. Status of CMOS RAM battery. 0=Battery voltage low. |
| | 1 | RO | **TT POWER FAILURE**. 0=battery failed while the system was powered off. |
| | 0 | RO | **POWER LATCH**. This bit is set to a 0 when the POWERFAIL input is 0. |
| $2 | | | **RANDOM NUMBER STORAGE REGISTER** |
| | 7-0 | RW | Bits cleared when certain devices are accessed |

Figure 6

BATTERY POWERED GAMING MACHINE SECURITY MONITORING SYSTEM

This application is a divisional of application Ser. No. 09/477,762 filed Jan. 4, 2000.

BACKGROUND OF THE INVENTION

This invention relates to battery powered security monitoring systems for gaming machines such as slot machines or video poker machines. More particularly, the present invention relates to secure monitoring of gaming machine access ports.

There are wide variety of associated devices that can comprise a gaming machine such as a slot machine or video poker machine. Some examples of these devices are lights, coupon dispensers, card readers, bill validators, coin acceptors, coin hoppers, display panels, key pads, and gaming controllers. Many of these devices are built into the gaming machine while some are grouped into separate units such as top boxes which may be placed on top of the machine.

Some gaming machine devices are considered more critical to the gaming machine operations than others. In particular, devices that control the input and output of money from the gaming machine are generally considered critical devices. The gaming controller, which controls the features of the game played on the gaming machine including the pay-out of a particular game as well as the gaming devices which output game pay-outs, is one of the most critical gaming devices, if not the most critical device. Specific examples of other critical devices include card readers, bill validators, ticket coupon readers, and coin acceptors which control the input of money into the gaming machine and note stackers, token dispensers, drop boxes and ticket/coupon dispensers which control the output of money from the gaming machine.

Access to a particular gaming machine device depends on the type of device. Input devices such as bill validators, coin acceptors, and card readers or output devices such as coupon dispensers or token dispensers are directly accessible. These devices have at least one access mechanism on the outside of the gaming machine so that the gaming machine may either accept money or indicia of credits from players desiring to play the game or pay-out money to a player playing a game. However, access to the mechanisms controlling the operation of these devices is usually behind one or more doors provided on the gaming machine exterior. The gaming controller and the money storage devices such as bill stackers and drop boxes are less accessible. These devices are usually only accessible after opening one or more doors or other barriers which limit access to these critical devices.

The doors which allow access to the critical devices are often secured with keyed locks. For security, when any of these doors are opened, the gaming machine must stop normal game play operation and switch to an attention state. Thus, it is necessary to detect whether a door is open or closed via an electronic means so that the operating software utilized by the gaming controller can take appropriate action.

Another access mechanism to gaming devices including bill validators, coin acceptors, token dispensers, gaming controllers, and coupon dispensers is through wires which accept and transmit signals which control the operation of the device. Typically, during the operation of the gaming machine, many of the associated gaming devices are controlled in some manner by the gaming controller located within the gaming machine. The control of a gaming device is enabled by the wires which connect a gaming device to the gaming controller. For example, when a player is playing a game and receives a pay-out during the course of a game, the gaming controller may send out a signal to a coupon dispenser, located in some of other part of the gaming machine away from the gaming controller, instructing the coupon dispenser to dispense a coupon representing the pay-out. Thus, access may be gained to a gaming device, via the wires connected to the gaming device.

A common mode of theft for gaming machines involves accessing the devices which control the input and output of money to the gaming machine through some access mechanism and manipulating the devices in some manner to obtain an illegal pay-out. For example, one type of theft might involve simply taking money from a drop box while a gaming machine is being accessed for maintenance. Another type of theft might involve illegally gaining access to the gaming controller and reprogramming the gaming controller to pay-out an illegal jack pot. Another type of theft might involve compromising the wires to a coupon dispenser and sending a signal instructing it to dispense coupons with some monetary value.

One method for preventing theft is installing a security system which monitors the various access mechanisms of a gaming machine. Typically, security devices of this type monitor access to the various entry ports within the gaming machine as well as the wires to some gaming devices. The security system monitors access to the entry port by sending out signals to sensors able to detect whether access to the entry port has occurred. Usually, the entry port contains a sensor device that forms some type of closed circuit when the entry port is closed and an open circuit when the entry port is open. When an entry port is opened, some information regarding this event is stored by the security monitoring system. For example, the security monitoring system might store information regarding whether a particular entry port was accessed during a particular period of time. This information can be used to determine when a theft has occurred or when tampering with the gaming machine has occurred.

Security monitoring of access to the gaming machine is usually implemented in some manner by the gaming controller during normal operations of the gaming machine in conjunction with some security monitoring hardware independent of the gaming controller. The security monitoring by the gaming controller is implemented while the gaming machine is receiving power from an external power source such as AC power from a power outlet. In the event the gaming machine is receiving no external power such as during a power failure or when the gaming machine is being stored or shipped, security monitoring of the gaming machine is carried out only by the independent security monitoring hardware powered by an internal power source within the gaming machine such as battery.

Since the door access security monitoring system is utilized to detect theft or tampering with gaming machine, some individuals desiring to steal or tamper with the gaming machine have developed methods for thwarting such devices. One disadvantage of current access mechanism security monitoring systems is that approaches to defeating the systems have been developed by obtaining a schematic of the circuitry hardware used in the system and developing techniques for preventing an access event from being recorded when an access has occurred. For example, connections between certain gates on the circuit could be rewired to prevent the circuit from detecting an access event. Accordingly, it would be desirable to provide a door access security monitoring system which contains custom circuitry which prevents this type of tampering.

Another disadvantage of current access mechanism security monitoring systems is that the approaches to tampering with the gaming machine between monitoring intervals by the system have been developed. For example, it is possible to open a door on gaming machine between monitoring intervals and then send out a false signal such that the security monitoring system never records that the gaming machine door has been opened. According, it would be desirable to provide an access security mechanism security monitoring system which prevents this type of tampering from occurring.

SUMMARY OF THE INVENTION

This invention addresses the needs described above by providing a security system that monitors validation signals detected by a sensor at least twice during each oscillation of the validation signal. This technique may be applied both while the main power to the gaming machine is on and while a backup power source (e.g., a battery) is on. Preferably, the security system of this invention employs a custom integrated circuit (e.g., an end-user programmed complex programmable logic device) to perform some the security functions such as supplying the validation signal to the sensor and comparing a sensor output signal to the validation signal to determine whether access to a gaming machine device has occurred.

One aspect of the present invention pertains to a gaming machine, which may be characterized by the following features: (a) a plurality of gaming devices coupled to the gaming machine (b) an access mechanism allowing access to one or more gaming devices of said gaming machine; and (c) access monitoring circuitry. The access monitoring circuitry preferably includes (i) a sensor including a signal emitter and a signal detector indicating when the access mechanism has been actuated in a manner in allowing access to one or more of the gaming devices; (ii) a source circuit providing an oscillating validation signal controlling operation of the sensor's signal emitter; and (iii) a detection circuit for monitoring the output of the sensor's signal detector in a manner sampling the output at least twice within a single oscillation.

Various sensors may be employed with this invention. Examples include optical sensors, magnetic sensors, and mechanical sensors. Likewise, various access mechanisms may be employed. Examples include locks, wires, retaining latches and device receptors. In a typical scenario, the access mechanism is provided on a door such as the main door of the gaming machine, a bill stacker door, a CPU security door, a belly door, a drop door and a coupon dispenser door. Depending upon the type of access mechanism employed, the access mechanism may be actuated by opening a door, unengaging a lock, accessing a signal path on wire, opening a retaining latch, or emptying a device receptor. In a specific embodiment, the detection circuit can monitor the output of at least 7 sensors simultaneously.

To obtain optimal security, the detection circuit should sample the output of the sensor's detector at times when the output magnitude is expected to be at different levels. In other words, if the output signal is expected to oscillate between high and low states (on and off states in a digital system), then that signal should be sampled while the signal is expected to be high and again while it is expected to be low. To conserve power, the high portion of the signal may be of much shorter duration than the low portion of the signal. Thus, it can be very important to time the sampling so that both the expected high and low portions of the output signal are sampled. In a preferred embodiment, the validation signal and a sample rate of the detector's output by the detection circuit are in synchronization and are at least 30 Hz.

In a specific embodiment, the access monitoring circuitry includes an inverter arranged to invert signals emitted by the source circuitry. Thus, the detection circuitry must expect to receive an inverted signal. If the signal is not inverted, access may have occurred. The access monitoring circuitry may require an amplifier arranged to amplify signals emitted by the source circuitry.

As mentioned, some or all of the security circuitry may be provided on an integrated circuit such as a custom integrated circuit. Examples of such custom ICs include programmable logic devices, field programmable gate arrays, and application specific integrated circuits. Preferably, the source circuit and the detection circuit are provided on a single integrated circuit.

As mentioned, the invention preferably operates while the gaming machine's main power supply is not operable. Thus, the gamine machine may include a battery that provides power to the source circuit and to the detection the sensor. Preferably, the battery can power the entire security system including the integrated circuit.

Another aspect of the invention provides a custom integrated circuit for use in detecting access via one or more access mechanisms of a gaming machine. As mentioned, examples of suitable custom integrated circuits include programmable logic devices, field programmable gate arrays, and application specific integrated circuits. In this embodiment, each of the access mechanisms has at least one associated sensor, as described above. The custom integrated circuit may be characterized by the following elements: (a) a source circuit providing an oscillating validation signal for controlling operation of a sensor's signal emitter; (b) a detection circuit for monitoring an output signal of the sensor's signal detector by sampling the output signal at least twice within a single oscillation of the validation signal; (c) comparison circuitry for comparing the values of the output signal sample and the validation signal at particular times; and (d) a storage region for storing data indicating when access has been detected by the comparison circuitry.

The integrated circuit may also include a power connection allowing a battery to be coupled to the custom integrated circuit such that the battery powers the source circuit, the detection circuit, and the comparison circuitry. Further, the integrated circuit may include a connection to a master clock that provides a timing signal with a frequency of 30 Hz or greater. Still further, the integrated circuit may include a connection allowing a device external to the custom integrated circuit to read the contents of the storage region.

In a preferred embodiment, the storage region is provided as one or more registers. One of these may be dedicated to storing access indicators for separate sensors on the gaming machine. In a specific embodiment, the storage region can provide information on at least 7 sensors. Another register may store a random number which is overwritten when access to special devices (e.g., the CPU) has occurred. A power status register may be provided for storing signals on the operational status of one or more power sources. Examples of such power sources include a main power supply, a battery for powering the sensor, and a battery for powering the storage region.

Yet another aspect of this invention pertains to a method of monitoring an access mechanism that allows access to one or more gaming devices within a gaming machine. The method employs a sensor that provides an output signal indicating whether the access mechanism has allowed access. The method may be characterized by the following sequence: (a) sending an oscillating validation signal to the sensor, the validation signal controlling generation of an emitter signal at the sensor; (b) detecting the output signal from a signal detector of the sensor; (c) comparing the value of the validation signal and the value of the output signal at least twice during a single oscillation; and (d) indicating access to the gaming machine when compared values of the validation signal and the output signal show that access to the gaming machine feature has occurred.

Preferably, the method also allows the security system to determine whether it is on main power or backup power. Different security protocols may be employed depending on whether main or backup power is used. Preferably, a backup power protocol drains energy at a low rate. In a specific embodiment, the method requires storing a power signal indicating whether the gaming machine is using normal power or backup power.

The method may indicate access by various mechanisms. For example, it may store a signal indicating that access has occurred through a specific access mechanism. The signal is stored in a non-volatile memory such as a register on a custom integrated circuit, as discussed above. For critical access mechanisms, the method may involve (i) storing an identical random string of numbers to two non-volatile memory locations within the gaming machine when main power is on to the gaming machine; and (ii) clearing the random number located within one of the non-volatile memory locations when access to one or more specified access mechanisms has occurred while main power is off.

Note that the method may also determine when main power to the gaming machine is off and then power the security system (including the sensor) with battery power. To allow the gaming machine to recognize that it is in a backup power state, the method may store a power signal indicating that primary power to the gaming machine is off. The method may further require (i)monitoring a voltage level in the battery; and (ii) clearing a battery status indicator stored in a non-volatile memory located on the custom integrated circuit when the battery voltage is below a defined level.

These and other features and advantages of the invention will be described in more detail below with reference to the associated figures.

BRIEF DESCRIPTION OF THE DRAWINGS

FIG. 6 is a table showing the functions of registers within the monitoring circuitry for one embodiment of the present invention provided for one embodiment of this invention.

DESCRIPTION OF THE PREFERRED EMBODIMENTS

Figure 1:
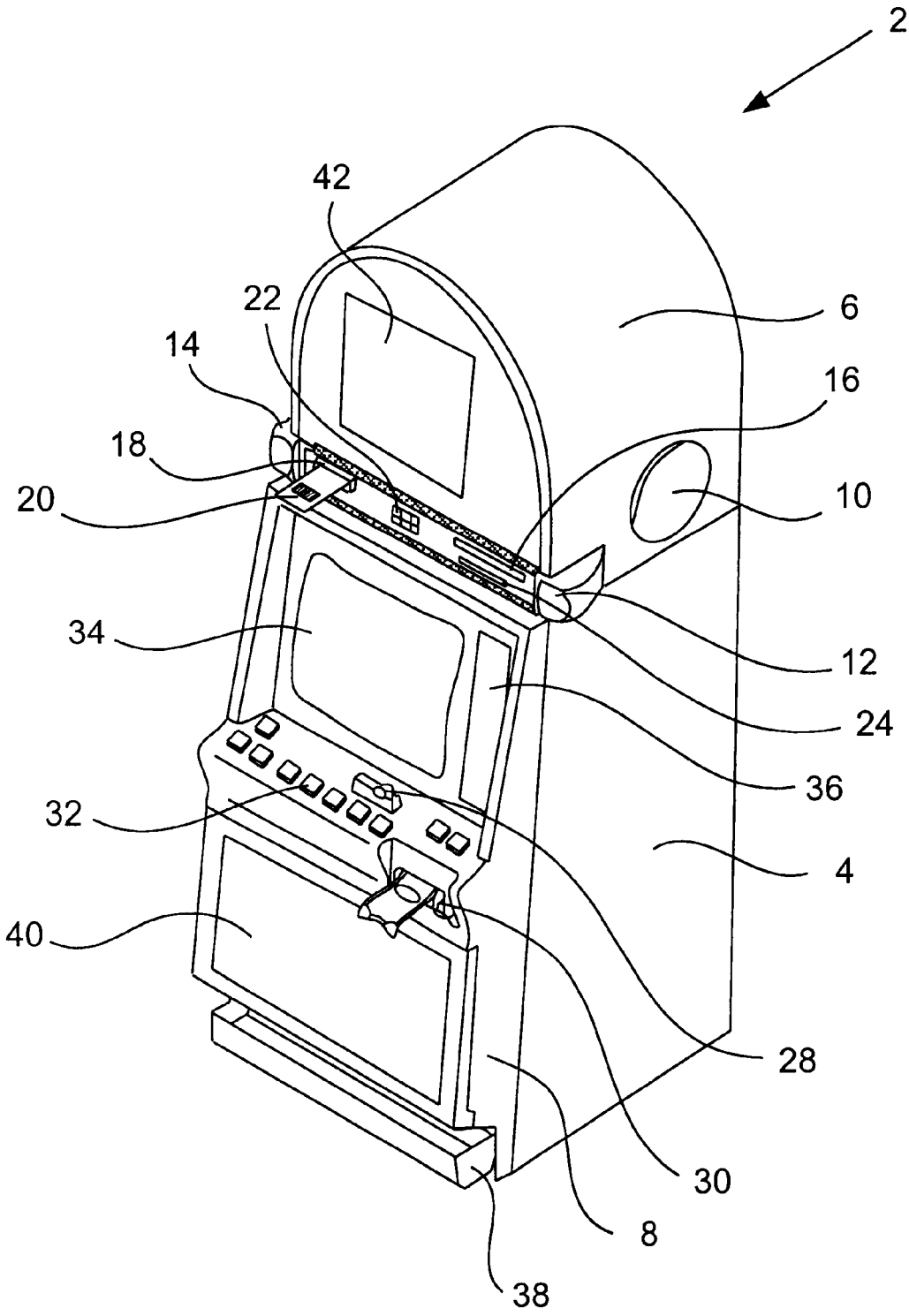
FIG. 1 is a perspective drawing of a gaming machine having a top box and other devices.

Turning first to FIG. 1, one example of a video gaming machine 2 of the present invention is shown. Machine 2 includes a main cabinet 4, which generally surrounds the machine interior (not shown) and is viewable by users. The main cabinet includes a main door 8 on the front of the machine, which opens to provide access to the interior of the machine. Typically, the main door 8 and/or any other portals which provide access to the interior of the machine utilize a locking mechanism of some sort as a security feature to limit access to the interior of the gaming machine. Also, for further security, various types of sensors may be employed at these entry portals to determine when an access has occurred. For example, the sensor may detect when the door is actuated from a closed position to an open position. Monitoring of these sensors may be carried out by hardware (not shown) located within the main cabinet 4. Attached to the main door are player-input switches 32, a coin acceptor 28, and a bill validator 30, a coin tray 38, a belly glass 40, and a monitor mask 42. The belly glass 40 has a door for maintenance purposes such as changing the glass or lights. This portal may provide indirect access to the interior of the gaming machine. For example, gaps may exist in the cabinet containing the lights for the belly glass.

Viewable through the main door is a video display monitor 34 and an information panel 36. The display monitor 34 will typically be a cathode ray tube, high resolution flat-panel LCD, or other conventional electronically controlled video monitor. The information panel 36 is a back-lit, silk screened glass panel with lettering to indicate general game information including, for example, the number of coins played. The bill validator 30, player-input switches 32, video display monitor 34, and information panel are devices used to play a game on the game machine 2. The devices are controlled by circuitry (not shown) housed inside the main cabinet 4 of the machine 2. Many possible games, including traditional slot games, video slot games, video poker, keno, and lottery, may be provided with gaming machines of this invention.

The gaming machine 2 includes a top box 6, which sits on top of the main cabinet 4. The top box 6 houses a number of devices including speakers 10, 12, 14, a glass panel with display lamps 16, a coupon dispenser 18 which prints bar-coded tickets 20, a key pad 22 for entering player tracking information, a florescent display 24 for displaying player tracking information, and a card reader 26 for entering a magnetic striped card containing player tracking information. The top box 6 may contain an entry portal of some type (not shown) to access the devices contained within the top box. This entry portal may contain a lock and sensors for monitoring access to the portal. Further, access to devices within the top box 6 may be monitored. For example, the coupon dispenser 18 may be used to print tickets for game credits. The coupon dispenser (not shown) may contain a door which allows access to the tickets utilized by the coupon dispenser. This entry portal may contain a lock and sensors for monitoring access to the portal.

The devices housed in the top box 6 add features to a game played on the machine 2. During a game, these devices are controlled, in part, by circuitry (not shown) housed within the main cabinet 4 of the machine 2. Further, additional circuitry (not shown) housed within the main cabinet 4 may monitor access to the top box 6 and possibly some devices within the top box. Cables (not shown) are routed from the top box 6 to the interior of the gaming machine to enable these control and monitoring functions.

When a user wishes to play the gaming machine 2, he or she inserts cash through the coin acceptor 28 or bill validator 30. Potentially, the bill validator 30 or a similar device may read tickets with game credits. The cash or game tokens from the coin acceptor 28 and bill validator 30 may be stored in the interior of the main cabinet 4 in devices including note stackers, drop boxes, and token dispensers. At the start of the game, the player may enter playing tracking information using the card reader 26, the keypad 22, and the florescent display 26. During the game, the player views game information using the video display 34. Usually, during the course of a game, a player is required to make a number of decisions, which affect the outcome of the game. The player makes these choices using the player-input switches 32. During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 including lights behind the front glass 16 on the top box 6 or from lights behind the belly glass 40. After the player has completed a game, the player may receive game tokens from the coin tray 38 or the ticket 20 from the printer 18, which may be used for further games. Further, the player may receive a ticket 20 for food, merchandise, or games from the printer 18.

Figure 2:
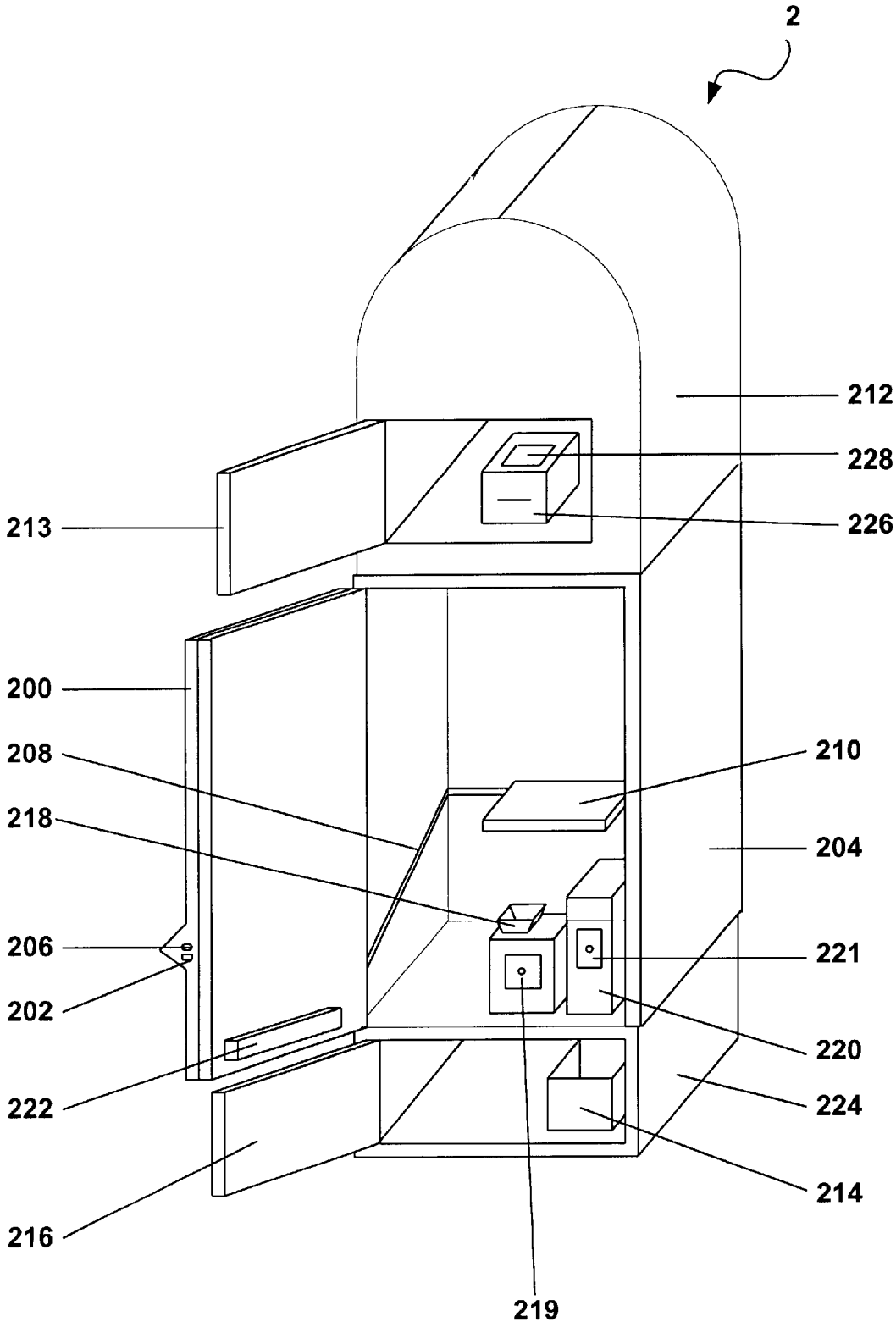
FIG. 2 is a perspective drawing of a gaming machine having a top box with the main door open and the interior exposed.

FIG. 2 is a perspective drawing of a gaming machine having a top box 212 with the main door 200 open and the interior of the gaming machine 2 exposed. The main door 200 contains a locking mechanism 202 and a main door sensor 206. Typically, the main door sensor 206 or any type of access sensor may be composed of two parts. Usually, one part of the sensor may be an emitter while the other part of the sensor may be a detector. The emitter and detector act like a switch in a circuit. When the detector is able to receive a signal of some type from the emitter, the sensor circuit is closed and signals may be passed through the circuit. When the detector is unable to receive a signal from the emitter the circuit will be open and a signal may not be passed through the circuit. By monitoring signals passed through the circuit, the status of the circuit, either opened or closed, can be determined. For a door, the sensor emitter and sensor detector may be designed such that signals from the detector can only be received from the emitter when the door is closed. As examples, the main door sensor 206 may be composed of optical sensors which emit and detect light, magnetic sensors which emit and detect a magnetic field, or a mechanical sensors which emit and detect current when the two parts of the sensor remain in contact with each other. The main door sensor 206 may have a second part mounted (not shown) on the inside of the main cabinet 204 which enables a closed circuit when the door is closed.

Mounted on the bottom of the main cabinet 204 and inside of the main door 200 may be a note stacker 220 and a token dispenser 218. The note stacker 220 stores bills accepted from the bill validator. The note stacker 220 may contain a door 221 which limits access to the bills stored within the note stacker 220. The note stacker 220 is typically locked or secured in some manner. A sensor may be mounted on the note stacker door 221 to detect when the note stacker door 221 is accessed. Examples of access to the note stacker, which might be detected using a sensor of some type including a optical sensor, magnetic sensor or mechanical sensor, comprise opening a door to access the money stored within the note stacker or removing the note stacker from the gaming machine. In both of these cases, a sensor pair composed of an emitter and detector could be used in conjunction with sensor monitoring circuitry to determine when these events have occurred. The token dispenser 218 accepts coins or tokens from the coin acceptor and pays out winning from the gaming machine. The token dispenser 218 may dispense coins or tokens into the coin tray 222 mounted on the main door 200 of the gaming machine 2. The token dispenser 218 may contain a door 219 which limits access to the tokens or coins stored within the token dispenser 218. Access to the token dispenser 218 may be monitored using a sensor of some type and monitoring circuitry.

The gaming machine 2 may be placed on top of a drop stand 224. The drop stand 224 may contain a drop stand door 216 and a drop box 214 located within the drop stand 224. The drop box 214 contains the house "take" from the gaming machine. The drop box 214 is typically locked within the drop stand 224 which may be accessed using the drop stand door 216. The drop stand 224 door typically contains a locking mechanism to limit access to the drop box and a sensor may be connected to sensor monitoring circuitry to determine when the drop stand door has been opened.

A master gaming controller 210 is also located in the interior of the main cabinet 204 of the gaming machine 2. The master gaming controller operates the games played on the gaming machine and the various devices needed to play to the game including the token dispenser 218 and the note stacker 220. Access to the master gaming controller may be limited by one or more doors including the main door 200. Further, the master gaming controller, which may be detached from the gaming machine, may be locked down using an additional device such as a retaining latch for additional security. One or more sensors including optical sensors, magnetic sensors and mechanical sensors may be placed near the master gaming controller to determine when one or more of the following events has occurred: 1) when doors allowing access to the gaming controller have been opened, 2) when a lock down device including the retaining latch for the gaming controller has been actuated, 3) when the gaming controller has been removed from its mounting bracket, 4) when a data port that allows the gaming controller to be programmed has been accessed or 5) when a lock to one of the access mechanisms including the door or the retaining latch has been unengaged. The sensor monitoring circuitry used to monitor the various access sensors may be located on the processor board containing the gaming controller 210. Information from the various sensors may be carried to the gaming controller via wires contained within a wire harness 208 which go to the various devices and sensors located within the main cabinet 204, main door 200, and top box 212.

The top box 212 may be accessed via a top box access door 213. The top box access door 213 typically contains a locking mechanism to limit access to the top box and a sensor may be connected to sensor monitoring security to determine when the top box access door has been opened. A printer 226 may be located within the top box 212. The printer may printer 226 tickets or coupons that may be used for additional game play on the gaming machine 2 or other gaming machines. Thus, the tickets or coupons stored within the printer 226 may be a target of theft. Access to the printer 226 may be limited by a printer access door 228. The printer access door 228 typically contains a locking mechanism to limit access to the printer and a sensor may be connected to sensor monitoring circuitry to determine when the printer access door has been opened.

A primary objective of the sensors and sensor monitoring circuitry may be gaming machine security. During gaming operations, the gaming machine 2 may contain a significant amount of cash stored within the devices including the token dispenser 218, the drop box 214, and the note stacker 220. When the main door 200 or drop stand door 216 of the gaming machine 200 is open, these devices are more accessible and may become a target of theft. Sensors to monitor access to these devices may serve as a deterrent to theft. Further, the master gaming controller 210 determines when a pay-out such as a jackpot should be made for a given game. For gaming machines linked in large networks, the potential jackpots can be very large. Thus, one mode of theft involves manipulating the master gaming controller 210 to falsely reward a pay-out or jackpot. Thus, the sensors that indicate when access to the master gaming controller may have occurred are usually closely monitored using a security monitoring system of some type.

The invention described herein is not limited to the gaming machine configuration shown in FIG. 2. Gaming machines and their associated devices may be physically configured in many different ways. For example, the top box access door 213 may be located on the sides or back of the top box 212 or the drop stand door 216 may be located on the sides or back of the drop stand 224. As another example, a note stacker or other devices potentially requiring a security monitoring system of some type might be located within the top box 212.

Figure 3:
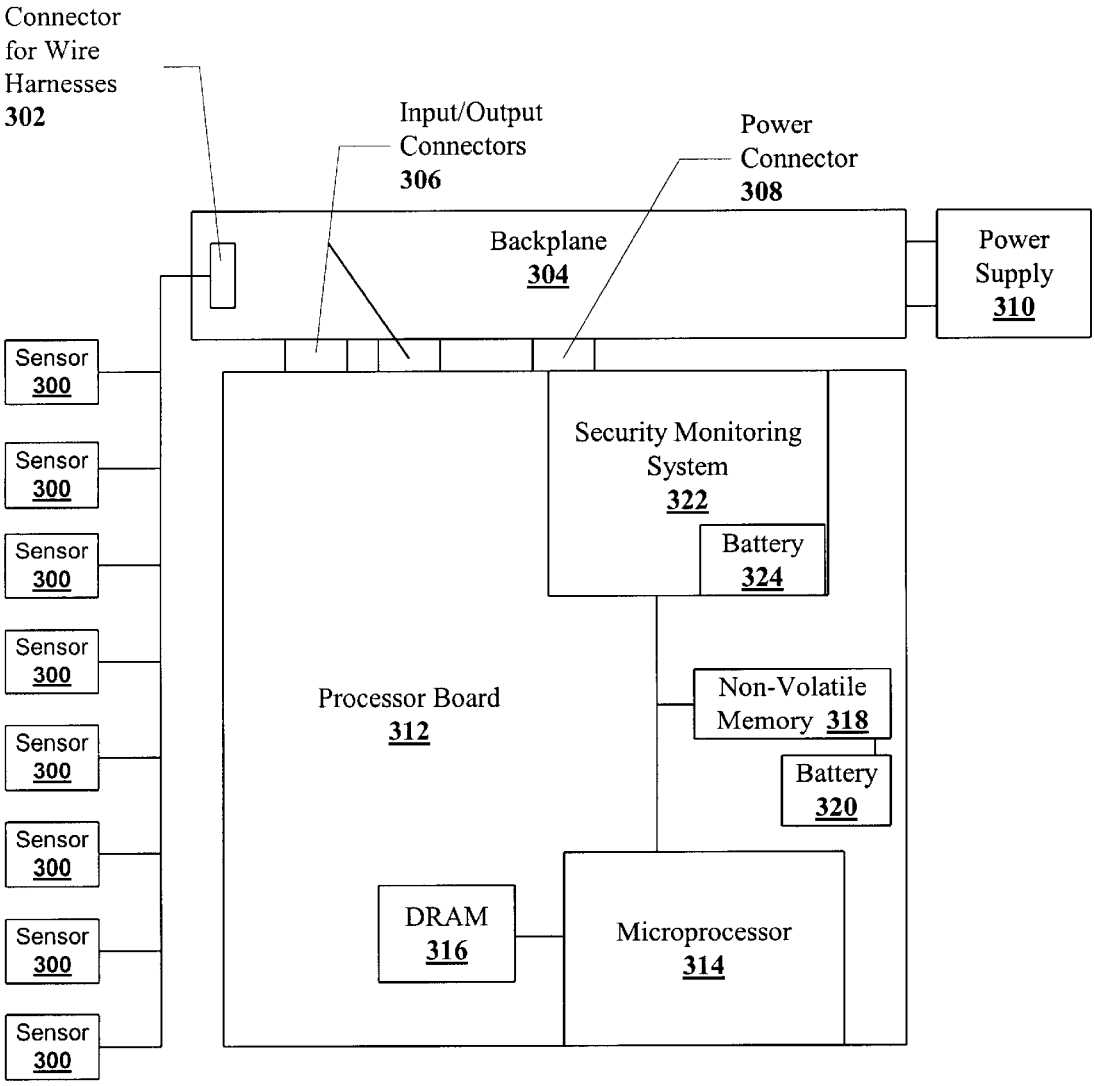
FIG. 3 is a block diagram depicting hardware utilized for gaming machine security monitoring provided for one embodiment of this invention.

FIG. 3 is a block diagram depicting hardware utilized for gaming machine security monitoring. For illustrative purposes, eight sensors 300, which may include optical sensors, magnetic sensors and mechanical sensors, and may be distributed throughout the gaming machine, are shown. The number of sensors may be less than or more than eight depending on the type of gaming machine. These sensors may be configured detect a number of different events including but not limited to when a door is opened, when a lock is unlocked, when a retaining latch is opened or when a device is removed from the gaming machine. For example, a sensor may detect when the main door of the gaming machine has been opened or when a processor board 312 has been detached from a "backplane" or motherboard 304. In a preferred embodiment, processor board 312 is connected to backplane 304, which may in turn be mounted to the main cabinet of the gaming machine. Signals to or from a given sensor may be carried through wires in a wire harness 302 to the backplane 304 and then via circuit traces and connectors to processor board 312.

In the figure, one potential embodiment of hardware used to monitor the sensors distributed throughout the gaming machine is shown. The processor board 312 contains a microprocessor 314—which typically serves as the master gaming controller—with DRAM 316 and a security monitoring system 322. Typically, the gaming machine is powered from an outside power source such as an AC power outlet. This AC power may be utilized by a power supply located within the gaming machine 310 to distribute power to the devices connected to the gaming machine. When the power supply 312 receives power from an outside source, the processor board may receive power through a power connector 308 to the back plane 304.

The security monitoring system 322 sends out signals to the sensors 300, processes signals arriving from the sensors 300 and stores information regarding the status of a given sensor. Information regarding the status of a given sensor may be used to determine when a door has been opened or when some other event which the sensor has been designed to detect has occurred. The monitoring of sensors by the security monitoring system 322 may occur when the gaming machine is receiving power from an outside source or when the gaming machine is disconnected from external power. When the gaming machine is disconnected from external power, a battery 324 may power the security monitoring system 322 as long the battery is functioning properly. The battery may be a rechargeable Nickel Metal Hydride or Nickel Cadmium cell, for example.

In addition, when the gaming machine is receiving power from an outside source and the processor board 312 is operating properly, the microprocessor 314 may load executable software into a DRAM 316 that enables the microprocessor 314 to sample a register located in the security monitoring system 322 with information regarding the status of the sensors 300. When a security event has occurred, such as an opening of the main door to the gaming machine, the microprocessor 314 may store this information in non-volatile memory 318 which is powered by a separate battery 320 and may take an additional actions including alerting an attendant and flashing a warning message on the gaming machine. The security monitoring performed by the microprocessor 314, which is software based, may be independent of the security monitoring performed by the security monitoring system 322 but is dependent on the information regarding the status of the sensors 300 gathered by the security monitoring system 322.

In a specific embodiment described herein, the security monitoring system 322 may independently monitor up to eight sensors. When more than eight sensors are employed, one or more sensors may be wired in a series and monitored. When two or more sensors are wired in a series, the security monitoring system may detect when either of the sensors has detected an event but can not distinguish between the event. For example, when two door sensors designed to detect when a door has opened are wired in a series and connected to the security monitoring system 322, the security monitoring system may detect when either door has been opened but can not distinguish between which door has opened or when both doors have been opened.

Figure 4:
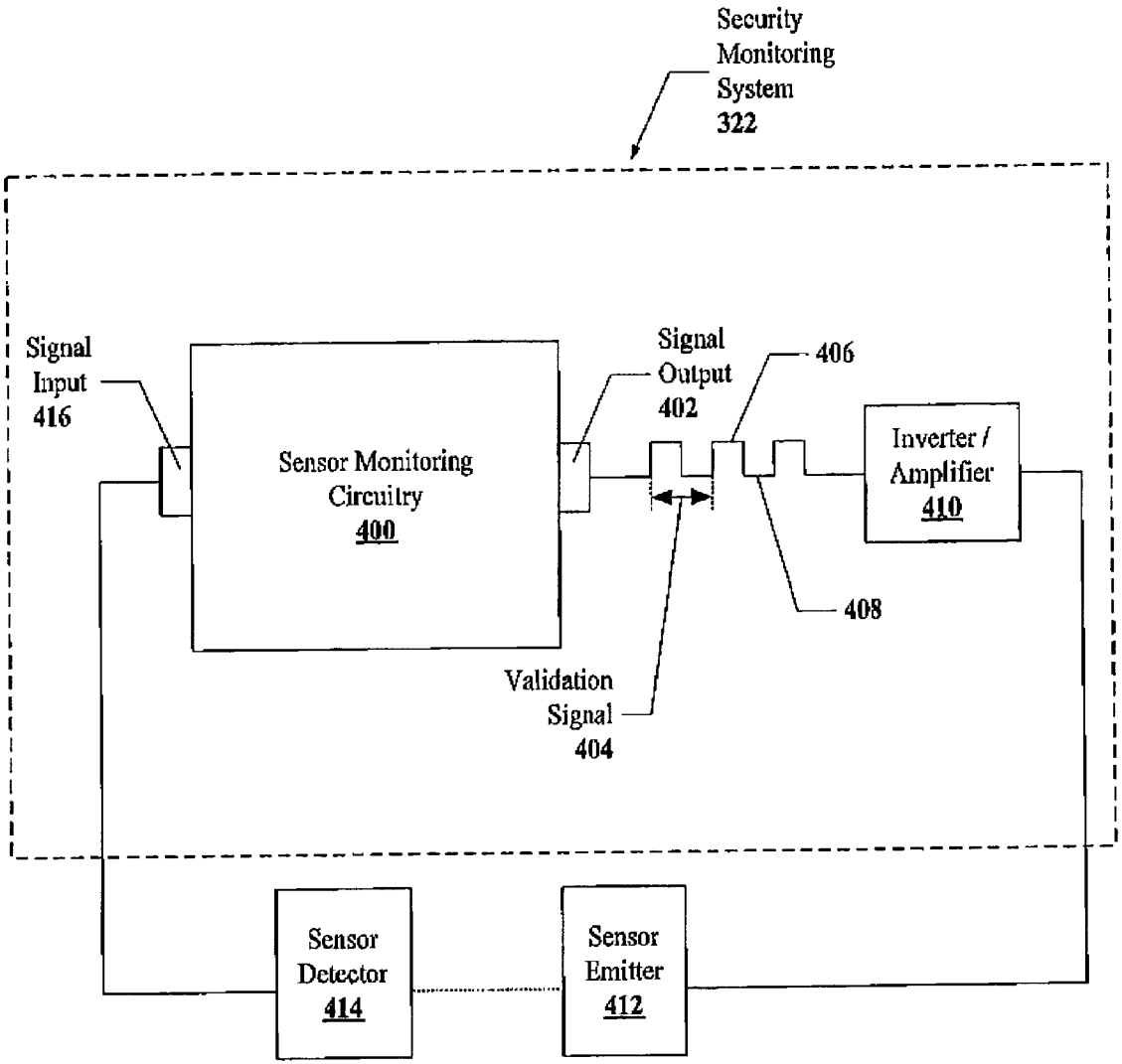
FIG. 4 is a block diagram depicting the battery powered security monitoring system connected to a sensor provided for one embodiment of this invention.

FIG. 4 is a block diagram depicting the battery powered security monitoring system 322 connected to a sensor. The security monitoring circuitry 400 sends out a validation signal 404 from the signal output 402. One oscillation of the validation signal 404 may be composed of an on pulse 406 which may be a signal of some magnitude and an off pulse 408 which may be a signal of some magnitude. The lengths of time of the on pulse 406 or the off pulse 408 may be varied and may not be the same for each pulse. For example, when the sensor monitoring circuitry 400 is being powered from the battery, the on pulse may be as short as 80 microseconds while the off pulse 408 may be as long as about 33 milliseconds of a second. The frequency of the validation signal may be 30 HZ or less.

The validation signal may pass through an inverter/amplifier 410. The inverter component may invert the validation signal 404 such that the magnitude of the on pulse 406 and the magnitude of the off pulse 408 are inverted. The load capacity of the on pulse 406 or the off pulse 408 may also be amplified by the amplifier component. After validation signal leaves the sensor monitoring system 322, it passes to the appropriate component(s) of the gaming machine via the backplane 304 as illustrated in FIG. 3.

The sensor emitter 412 receives an on pulse 404 from the inverter/amplifier 410. In response to the on pulse 404, the sensor emitter 412 may send a signal to the sensor detector 414. For example, for a light sensor 412, the sensor emitter might send a light pulse of some type which might be detected by the sensor detector 414. For a magnetic sensor, a magnetic pulse might be sent out by the sensor emitter 412 which might be detected by the sensor detector 414. For a mechanical sensor, the sensor emitter might pass an electric current to the sensor detector 414 where the emitter and the detector of the mechanical sensor might be in contact.

Typically, the emitter and detector pair of a sensor are configured to detect an binary event. For example, an open or closed door, an empty or full receptacle for a component, an open or closed retaining latch or an engaged or unengaged lock are a few types of binary events which a sensor pair might be configured to detect. The sensor pair may be configured such that the detector can detect a signal from the emitter only for one event of the binary pair. For example, for detecting when a door is open or closed, the detector may be configured such that the detector can only receive a signal from the emitter when the door is closed. Thus, for a light sensor, the detector would normally only be able receive a light pulse from the emitter when the emitter has been activated by an on pulse and the door is closed. If the door is open, the detector has moved away from the optical path of light from the emitter, so the detector detects no signal. For a magnetic sensor, the detector would normally only be able receive a magnetic pulse from the emitter when the emitter has been activated by an on pulse and the door is closed. For a mechanical sensor, the detector would be able to receive a signal from the emitter while the emitter and detector remain in contact.

When the sensor detector 414 receives a signal from the sensor emitter 412, it may send out an "on" signal of some type to the signal input 416. When the sensor detector 414 does not receive a signal, an "off" signal of some type may be received by the signal input 416. The signal received by the sensor monitoring circuitry 400 may be synchronously compared to the validation signal output by the sensor monitoring circuitry 400. An "on" or "off" signal sent out through the signal output 402 by the sensor monitoring circuitry 400 should propagate through the circuit within a specified time interval. A timing signal may be generated by timing circuitry within the sensor monitoring circuitry 400. Thus, an "on" or "off" signal received by the sensor monitoring circuitry 400 through the signal input 416 may be matched to an "on" or "off" validation signal sent out through the signal output 402 based on the timing signal from the timing circuitry. This comparison of output and input signal pairs may occur at an interval of 30 Hz or less.

The sensor emitter 412 and the sensor detector 414 can be configured to produce an on or off signal at the signal input 416 based upon an on or off signal received by the sensor emitter 412. For example, an off signal received by the sensor emitter 412 may produce on or off signal by the sensor detector 414 depending on how the sensor is configured. Also, because of the inverter 410 in the circuit loop, the on or off signal received by the sensor emitter 412 may differ in phase from the on or off signal sent by the signal output 402. However, within the sensor monitoring circuitry 400, the on or off signal sent out through the signal output 402 may be matched based on the timing signal to an on or off signal received by the signal input 416 to produce four signal pairs (on, on), (on, off), (off, on), (off, off) where the first signal in the pair is the on or off signal component emitted from the sensor monitoring circuitry through the signal output 402 and the second signal in the pair is the on or off signal component received by the sensor monitoring circuitry through the signal input 416.

The four signal pairs can be used to determine a binary detection event including an open or closed door, an engaged or unengaged lock, an open or closed retaining latch or an empty or full component receptor. For example, for monitoring when a door is closed or open, the signal pairs (on, on) and (off, off) might indicate the door is opened, a device failure, a wire failure or wire harness tampering. The signal pairs (on, off) and (off, on) might indicate represent an indeterminate state i.e. the door could be opened or closed but the state can not be differentiated. However, consecutive states of (on, off) and (off, on) may be used to detect when the door is open. Again, the events that these values represent can vary depending the sensor circuitry and how the sensors are configured to monitor a given detection event.

The four signal pairs may be used to determine a binary detection event including an open or closed door, an engaged or unengaged lock, an open or closed retaining latch, an empty or full component receptor or a cut or uncut wire harness. For example, in one embodiment of the present invention, for monitoring a door, the signal pairs (on, on) and (off, off) might indicate the door is opened, a device failure, a wire failure or wire harness tampering. The signal pairs (on, off) and (off, on) might indicate represent an indeterminate state i.e. the door could be opened or closed but the state can not be differentiated. However, consecutive states of (on, off) and (off, on) may be used to indicate the door is closed. Again, the events that these values represent can vary depending the sensor monitoring circuitry and how the sensors are configured to monitor a given detection event. When power is on to the main gaming machine, the interpretation of these signals and the determination of a binary detection event may be made by software residing on the master gaming controller of the gaming machine. When power is off to the main gaming machine, the interpretation of these signals and the determination of a binary detection event may be made by the sensor monitoring circuitry.

The sensor monitoring circuitry may be configured such that an "on" signal received by the sensor monitoring circuitry 400 at the signal input 416 means the sensor monitoring circuit is open and an "off" signal received by the sensor monitoring circuitry 400 at the signal input 416 means the sensor monitoring circuit is closed. When the door is closed, the sensor monitoring circuitry 400 may be configured to detect an "on" signal at the signal input 416 in response to an "off" signal emitted by the signal output 402 i.e. an (off, on) signal pair. Further, when the door is closed, the sensor monitoring circuitry 400 may be configured to detect an "off" signal at the signal input 416 in response to an "on" signal emitted by the signal output 402 i.e. an (on, off) signal pair. The on and off signals emitted at the signal output 402 may be alternated at a frequency of 30 Hz or less. Thus, when the door is closed, consecutive pairs of (on, off), (off, on) or (off, on), (on, off) may be detected by the sensor monitoring circuitry 400 or by software residing on the master gaming controller within the gaming machine.

For a door sensor, the (on, on) or (off, off) signal pairs, might occur when an attempt is made to tamper with the gaming machine. For example, when an "on" signal is sent by the signal output 402, an attempt to tamper with the gaming machine might be made by grounding the signal input 412 to the sensor monitoring circuitry 400 to produce an "off" signal at the signal input 412 before the "off" signal sent by the sensor detector 414 in response to the "on" signal is received by the signal input 416. This tampering attempt might produce an (on, off) signal pair within the sensor monitoring circuitry 400 which would not be interpreted as an open door in this example. In the next time interval, an "off" might be emitted by the signal output 402. However, when the signal input 416 is grounded from the tampering attempt, an (off, off) signal pair might be produced and detected within the sensor monitoring circuitry 400. This (off, off) signal pair might be interpreted by software on the gaming machine or the sensor monitoring circuitry as an error condition resulting from an illegal door open, a harness tamper, or a device failure. The detection of the error condition might be stored and the gaming machine attendants might be alerted.

When an "off" signal is sent by the signal output 402, an attempt to tamper with the gaming machine might be made by cutting the wires in the wire harness to the signal input 412 to the sensor monitoring circuitry 400 to produce an "on" signal at the signal input 412 before the "on" signal sent by the sensor detector 414 in response to the "off" signal is received by the signal input 416. This tampering attempt might produce an (off, on) signal pair within the sensor monitoring circuitry 400 which would not be interpreted as an open door in this example. In the next time interval, an "on" signal might be emitted by the signal output 402. However, when the wires to the signal input 416 are cut from the tampering attempt, an (on, on) signal pair might be produced and detected within the sensor monitoring circuitry 400. This (on, on) signal pair might be interpreted by software on the gaming machine or the sensor monitoring circuitry as an error condition resulting from an illegal door open, a harness tamper, or a device failure. The detection of the error condition might be stored and the gaming machine attendants might be alerted.

In the case of device failure, an (on, on) signal pair or (off, off) signal pair may be detected by the sensor monitoring circuitry. For example, a wire with a short, which might cause the sensor monitoring circuit to remain closed, might produce an (off, off) signal pair. As another example, a broken wire, which might cause the sensor circuit to remain open, might produce an (on, on) signal pair. The detection of these device failure error conditions might be detected by software on the gaming machine or the sensor monitoring circuitry 400. When these errors are detected, the error condition might be stored and the gaming machine attendants might be alerted.

Many scenarios may be imagined involving tampering with a gaming machine. The examples described above are meant to demonstrate how one embodiment of the invention described herein might be implemented under a scenario where an attempt is made to tamper with a door sensor and its associated wiring. However, embodiments of the present invention are applicable to monitoring sensors that detect a binary detection events including an open and closed door, an engaged or unengaged lock, an open or closed retaining latch or an empty or full component receptor. The configuration of the sensors, the sensor monitoring circuitry and the interpretation of the signal pairs used in these embodiments may or may not differ from the examples described above.

Figure 5:
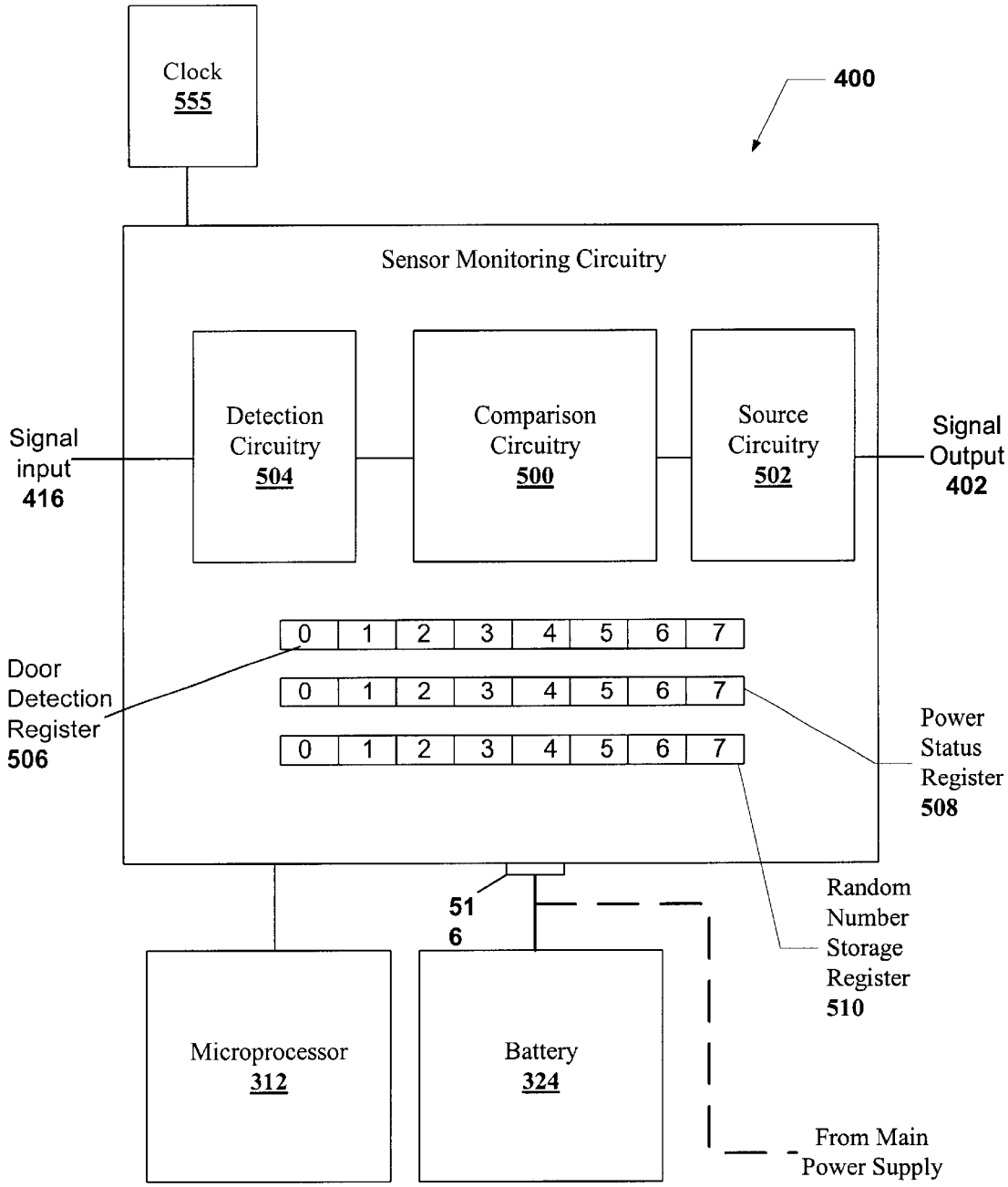
FIG. 5 is a block diagram depicting the sensor monitoring circuitry of the battery powered security monitoring system provided for one embodiment of this invention.

FIG. 5 is a block diagram depicting the sensor monitoring circuitry 400 of the battery powered security monitoring system. Sensor monitoring circuitry 400 may be built on a custom electronic device of some type including a programmable logic device, a field programmable gate array or an application specific integrated circuit. These custom circuits may be designed as a "black boxes" such that the internal logic used to process the signals input and output by the circuit is not easily determined. Unlike general purpose microprocessors, the gate level circuitry of a custom integrated circuit need not be published. When the internal logic of the sensor monitoring circuitry can be easily determined, then methods may be devised to defeat the sensor monitoring circuitry. In the past, for example, off-the-shelf circuits were used to design the sensor monitoring circuitry. For these devices, it was possible to obtain a schematic or a copy of the circuit which were used to determine the internal logic of the circuit and to devise methods to defeat the sensor monitoring circuitry. The use of "black box" custom circuits in the current invention makes this approach to tampering much more difficult and thus increases the overall security of the gaming machine.

The source circuitry 502 includes logic for emitting a validation signal through the signal output 402 to one or more sensors as described in FIG. 4. The detection circuitry 502 includes logic for receiving a signal from one or more sensors through the signal input 416 as described in FIG. 4. The sensor monitoring circuitry 400 may be powered from a power supply located within the gaming machine which receives power from outside the gaming machine or by a battery 324 located within the gaming machine. When the power is off, the circuitry may be designed to minimize the amount of power consumption to extend the length of time the sensor monitoring circuitry may operate on the battery.

The comparison circuitry 500 includes logic for comparing the signals emitted from the source circuitry 502 with the signals received from the detection circuitry 504. In the comparison circuitry 500, when an on or off pulse is emitted from the source circuitry 502, the value of the pulse, which may be stored as a 1 or 0 in a storage register, may be compared with a signal received from the detection circuitry 504, which may be stored as a 1 or 0 in a storage register. This comparison may be carried out within a specified timing interval in a synchronous manner such that the signal received from the detection circuitry 504 corresponds to a response from the sensor to a particular signal emitted by the source circuitry 502. Thus, the comparison circuitry 500 compares a signal pair composed of a signal emitted from the source circuitry 502 and the response the sensor to this signal received by the detection circuitry 504. Typically, for a given time interval, the source circuitry 502 will emit a similar signal to all of the sensors connected to the sensor monitoring circuitry 400. For example, when eight sensors are being monitored, the source circuitry may send out eight "on" signals to each of the sensors during a given time interval. However, the response of each sensor to the "on" signal depends on the status of each sensor device.

The timing interval for the comparison in the sensor monitoring circuitry 400 is determined from timing signals generated by logic in the clock circuitry 555 which may be a separate integrated circuit. For example, a CMOS timer may provide the logic for the clock circuit 555 used to generate the timing signal. The synchronous comparison of signals occurs twice a cycle i.e. for both the on and off portions of the validation signal. In a preferred embodiment, the validation signal is emitted at a frequency of about 30 Hz or less.

Three storage registers may be utilized by the sensor monitoring circuitry. The details of the contents of these registers are described in FIG. 6. The door detection register 506, the power status register 508, and the random number storage register 508 store information regarding the status of particular sensors which may be used by the gaming machine to determine the outcome of a binary event including whether a door is opened or closed, a security mechanism is locked or unlocked, or an component receptor is full or empty. Further, these registers contain information that affects the operation of the sensor monitoring circuitry 400.

Monitoring circuitry 400 receives power via a power connector 516. Depending upon the current mode of operation, that power is supplied by a main power source to the gaming machine or battery 324. When the gaming machine is receiving power from an outside source, the microprocessor 314 may sample these registers to determine the outcome of one or more binary events detected by sensors connected to the sensor monitoring circuitry based on software loaded into the microprocessor. When the gaming machine is not receiving power from an outside source, the sensor monitoring circuitry 400 can detect the outcome of one or more binary events detected by sensors connected to the sensor monitoring circuitry based on the hardware within the sensor monitoring circuitry as long as the battery 324 generates power. The outcome of these events may be stored in one or more registers within the sensor monitoring circuitry 400 for access by the microprocessor 314 when the gaming machine is receiving power from an outside source.

FIG. 6 is a table showing the functions of registers within the sensor monitoring circuitry in FIG. 5 for one embodiment of the present invention. Three 8 bit registers are described: 1) the Detect/Control Register, 2) Power Status Register and 3) Random Number Storage Register. As needed, more or less registers could be employed and the size of the registers adjusted. For each register, the address, the bit number, the direction and the function of each bit are described for a number of operational modes. The address refers to a location in memory used to access the register. The bit refers to the number of a particular bit in the register. The direction refers to the type of information access for a bit in the register where RO is "read only", WO is "write only", and RW is "read and write". These registers comprise a portion of the security monitoring circuitry which can be accessed by the operating software on the gaming machine.

The Detect/Control Register may be used for three functions: 1) determining, in conjunction with the gaming controller software, when binary events such as open or closed doors occur when power is on to the gaming machine, 2) storing, independently of the gaming controller software, the outcome of binary events such as open or closed doors that occur when power is off to the gaming machine, and 3) resetting the sensor monitoring circuitry. For the first function, when the Power Mode equals 1 and the gaming machine is properly receiving power, the gaming controller may utilize software to sample the door validation pulse in bit 7 and the detection input signals in bits 6–0. The validation pulse is the signal emitted by the source circuitry 502 in FIG. 5 and the input signals may be the response by each sensor to the validation pulse. As described above, the validation signal may be the same for each sensor such that it can be stored in one bit of the register. An example of how the detection inputs might be utilized is as follows. The values in bits 0–5 could be used to indicate the status of the main door, the drop door, bill stacker door, the CPU security door, and the belly door while bit 6 could be a spare.

The value of the validation pulse bit may be paired with the value for each detection input bit to determine the status of each door or any other binary event for which a sensor may be configured to detect as well as the status of the wiring to the sensors. For each sensor, the value of the validation pulse bit and the value of the detection input bit form a signal pair during a given time interval. The possible values of the signal pairs may be (1,1), (1,0), (0,1), (0,0) where the value of the validation pulse bit is the first number in the signal pair. As previously described, these signal pairs may be utilized by the gaming controller to detect certain events including whether a door is open or closed. When the power is on (Power Mode=1), the software utilized by the gaming controller may sample the validation pulse bit and the detection input bits at a rate which is equal to or greater than the rate at which the registers are updated by the sensor monitoring circuitry. For example, the sensor monitoring circuitry may update the validation pulse bit and the detection input bits at a frequency of 30 Hz while the software utilized by the gaming controller may sample the bits at a frequency of about 60 Hz.

A second possible function of the Detect/Control register may be to store information regarding the outcome of binary events including open or closed doors that occur when the gaming machine is not receiving outside power. When the Power Mode=0 and the sensor monitoring system is receiving power from a battery or some other alternative power source, the sensor monitoring circuitry sends validation signals to sensors connected to doors and other devices to determine the outcome of a binary events including whether a door is opened or closed as well the status of wiring to the sensors. For a given sensor, when the sensor monitoring circuitry detects a signal pair that corresponds to a particular critical event including an open door or an unlocked device, the sensor monitoring circuitry may store a value, either 1 or 0, in one of the 6 detection register bits which corresponds to the sensor. For a given sensor, a value of either 1 or 0 in the detection register bit may used to indicate that when the main power was off to the gaming machine one or more critical events occurred and at least one of these critical events was detected by the sensor monitoring circuitry. When power is restored to the gaming machine, the gaming controller may read the detection register and place the gaming machine in an attention state when any one of the detection register bits indicate that a critical event occurred while power was off to the gaming machine.

For example, when the detection register bit, 0, corresponds to the main door, the first time the sensor monitoring circuitry detects that the main door may have been opened, the wiring may have been compromised to the main door sensor or an attempt may have been made to tamper with the main door sensors, a value of 1 may be stored in the detection register bit 0. When the sensor monitoring circuitry has set a particular detection register bit to a value of 1 while the Power Mode=1, the value in this detection register bit may not change when the sensor monitoring circuitry detects another critical event which might result in this bit being set to a value of 1. Thus, for example, while the main power was off, the main door could be opened 100 times and the sensor monitoring system might detect each of these critical events. However, the detection register bit corresponding to the main door might only be set to a value of 1 one time. Thus, when the value in this register was read, it would not be possible to determine how many times the main door was opened.

The third function of the detect/control register may be to reset the sensor monitoring circuitry after a power failure. For example, when a power failure occurs during gaming machine operations, the sensor monitoring circuitry may switch from a Power Mode=1 which involves monitoring of the sensors by the gaming controller software to a Power Mode=0 which involves monitoring of the sensors by the sensor monitoring circuitry under battery power. When power is restored to the gaming machine, the gaming controller software may access the detect/control register and the power status register, to determine whether a critical event has occurred while the power was off to the gaming machine. Details of this power-up procedure are described in FIG. 8. When the gaming control software determines that no critical events occurred while the power was off, the gaming control software may execute a write to the control register to allow the sensor monitoring circuitry to return to real-time monitoring of the sensors by the gaming controller software i.e. Power Mode=1.

The Power Status Register stores information regarding the status of the power to the sensor monitoring circuitry and can be used like the detect/control register to store information regarding binary events. The functions of the validation pulse level bit, bit 7, and the detection input bit, bit 6, are similar to those described for the Detect/Control register. For example, the validation pulse bit and the detection input bit may be used to reflect the state of the card cage retention mechanism and the power interlock. An unlocked cage may cause the power supply to turn off. In the time between opening the card cage lock and system power going off, software may read the state of this input to determine that the machine was powered off by the lock being opened versus the power switch being turned off.

In the Power Status Register, the POWERFAIL bit, bit 5, is a real-time indication of a power failure or of a power interruption from the power supply. Thus, the POWERFAIL bit may indicate that the gaming machine is having some power difficulties. An indication of power difficulties might cause the sensor monitoring circuitry to switch the POWER MODE bit, bit 4, from POWER MODE=1 to POWER MODE=0. The TTBATLOW bit, bit 3, may indicate that the battery voltage for the security monitoring circuitry is running low and the battery needs to be recharged or replaced. When the main power is on to the gaming machine, the TTBATLOW bit may be set by the operating software on the gaming machine. When the power is off to the gaming machine and the battery voltage drops below a certain level, the TTBATLOW bit may be cleared by the security monitoring circuitry. When the main power is off to the gaming machine, the battery is used to power the sensor monitoring circuitry and the sensors. SRAMBATLOW bit, bit 2, may indicate that the CMOS memory battery voltage is running low or needs to be replaced. TT POWER FAILURE bit, bit 1, may indicate the battery to the sensor monitoring circuitry failed while the sensor monitoring circuitry was under battery power. Thus, the data stored in the detection registers may be unreliable. The Power Latch bit, bit 0, may be used to indicate the power status of the gaming machine.

The Random Number Storage Register may be an 8 bit Read/Write register which allows software utilized by the gaming controller to store a byte of information. It provides additional security for the gaming machine. While the gaming machine is receiving outside power, the values of the bits in the register can be set to a randomly generated pattern and the same information, i.e. the values of each bit, can be stored in another non-volatile memory location elsewhere in the gaming machine. For example, see the non-volatile memory in FIG. 3. When a significant security event occurs while the power is off to the gaming machine and the sensor monitoring circuitry is operating properly, the Random Number Storage Register is cleared. For example, the Random Number Storage Register might be cleared when the sensor monitoring circuitry detects the main door has been opened, the CPU security door has been opened or the back up battery has been exhausted. When power is restored to the gaming machine, the gaming controller software can compare the values in each bit of the Random Number Storage Register with the values stored in the other non-volatile memory location. When the values are different, the values in the Detection Register may not reliable. For example, the values may not be reliable because the battery may have failed to the sensor monitoring circuitry or tampering with the sensor monitoring circuitry may have occurred.

Figure 7:
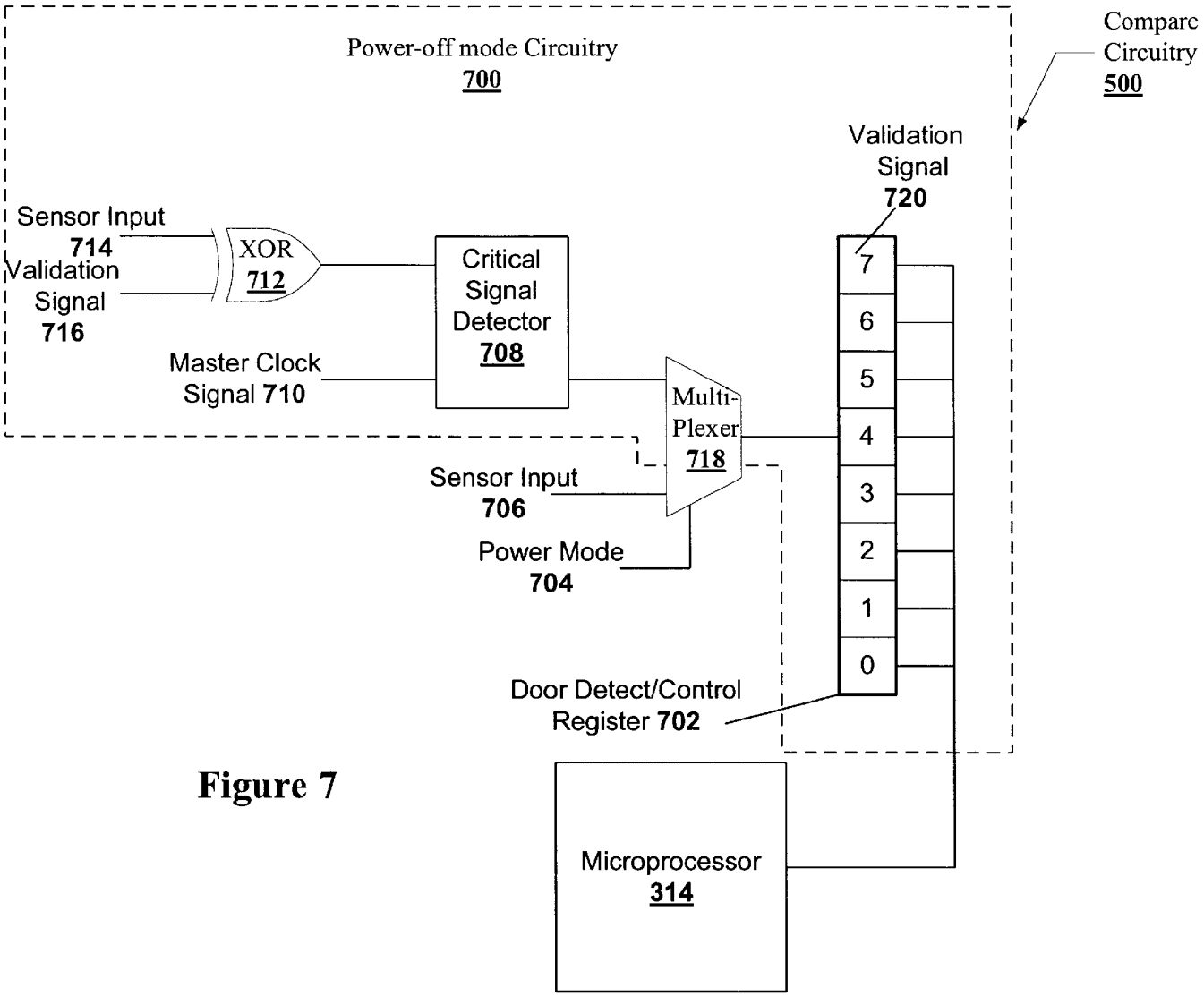
FIG. 7 is a block diagram depicting aspects of the power-off/power-on monitoring circuitry of the battery powered security monitoring system provided for one embodiment of this invention.

FIG. 7 is a block diagram depicting aspects of the sensor monitoring circuitry of the battery powered security monitoring system for Power Mode=1 or Power Mode=0 as described in FIG. 6. Blocks representing the compare circuitry 500 and the detect/control register are shown in FIG. 5. The functions of each bit in the detect/control register were described in regards to FIG. 6. The figure shows a potential embodiment of the hardware for monitoring events from the various sensors while the compare circuitry 500 is being operated with power from the gaming machine, Power Mode=1, or under battery power, Power Mode=0. The potential circuitry is shown only for one sensor input connected to bit number 4 in the detect/control register 702. Similar circuitry may be used for the bits 0–3, 5 and 6.

For a given sensor, the compare circuitry 500 compares a signal emitted from the sensor monitoring circuitry to a sensor with a signal received from the sensor in response to the signal emitted by the sensor monitoring circuitry. These signals are compared to determine the status of certain binary events including when a door is opened or closed. When the compare circuitry 500 is receiving outside power, Power Mode=1, the value of the Power Mode bit 704 may be input into the multiplexer 718 such that a value of 1 or 0 representing a state of the sensor input signal 706 may be stored in bit number 4 of the detect/control register 702. Software utilized by the microprocessor 314 may sample the information stored in the detect/control register 702, to determine the status of a particular sensor. For example, the software might sample the value of bit 4 which may contain information regarding the state of the sensor connected to bit 4 and the value of bit 7 which may contain information regarding the state of the validation signal 720 to determine the status of the sensor connected to bit 4 in the detect/control register 702. The data in the detect/control register 702 is updated regularly by the sensor monitoring system. For example, the data in the detect/control register 702 may be updated by the sensor monitoring circuitry at a frequency of 30 Hz or less. However, the microprocessor may sample the detect/control register 702 at an equal or greater rate than the update rate of the sensor monitoring circuitry.

When the compare circuitry 500 is under battery power, Power Mode=0, the Power Mode bit 704 may be input into the multiplexer 718 such that the power-off mode circuitry 700 may be utilized. The power-off mode circuitry may directly compare signals from the sensor input 714 with a validation signal using the XOR logic 712. The signal from the XOR logic 712 is monitored by the critical signal detector 708 at regular intervals based on timing signals received from the master clock 710. After passing through the multiplexer 718, the signal from the critical signal detector 708 may be stored in the detect/control register 702. In the figure, bit 4 is used as a storage register but similar circuitry (not shown) also exists for bits 0–3, 5, and 6. Further, this circuitry might be duplicated for all the sensors that are connected to the compare circuitry.

When a critical event occurs including the main door or the CPU door being opened and this event is detected by the Power-off mode circuitry 700, then the critical signal detector 708 may begin to emit a constant signal with a value of either 1 or 0 which represents the critical event as long as the Power Mode=0 and the sensor monitoring circuitry battery is still generating sufficient power. For example, when a value of 1 represents a critical event such as a door being opened and when the critical signal detector receives this signal from the XOR 712, the critical signal detector 708 may send this signal during a given time interval to the multiplexer 718 and the multiplexer may send the signal to the detect/control register 702. Once the critical signal detector 708 detects a critical signal value such as a value of 1, it may continue to send a signal with this value without consideration of the value of the signal received by the XOR 712 during subsequent time intervals. Thus, in the current example, during subsequent time intervals the critical signal detector 708 may receive a signal value of 1 or 0 from XOR 712, for example, from a door being repeatedly opened and closed, but the critical signal detector 708 may only send a value of 1 to the multiplexer 718.

Figure 8:
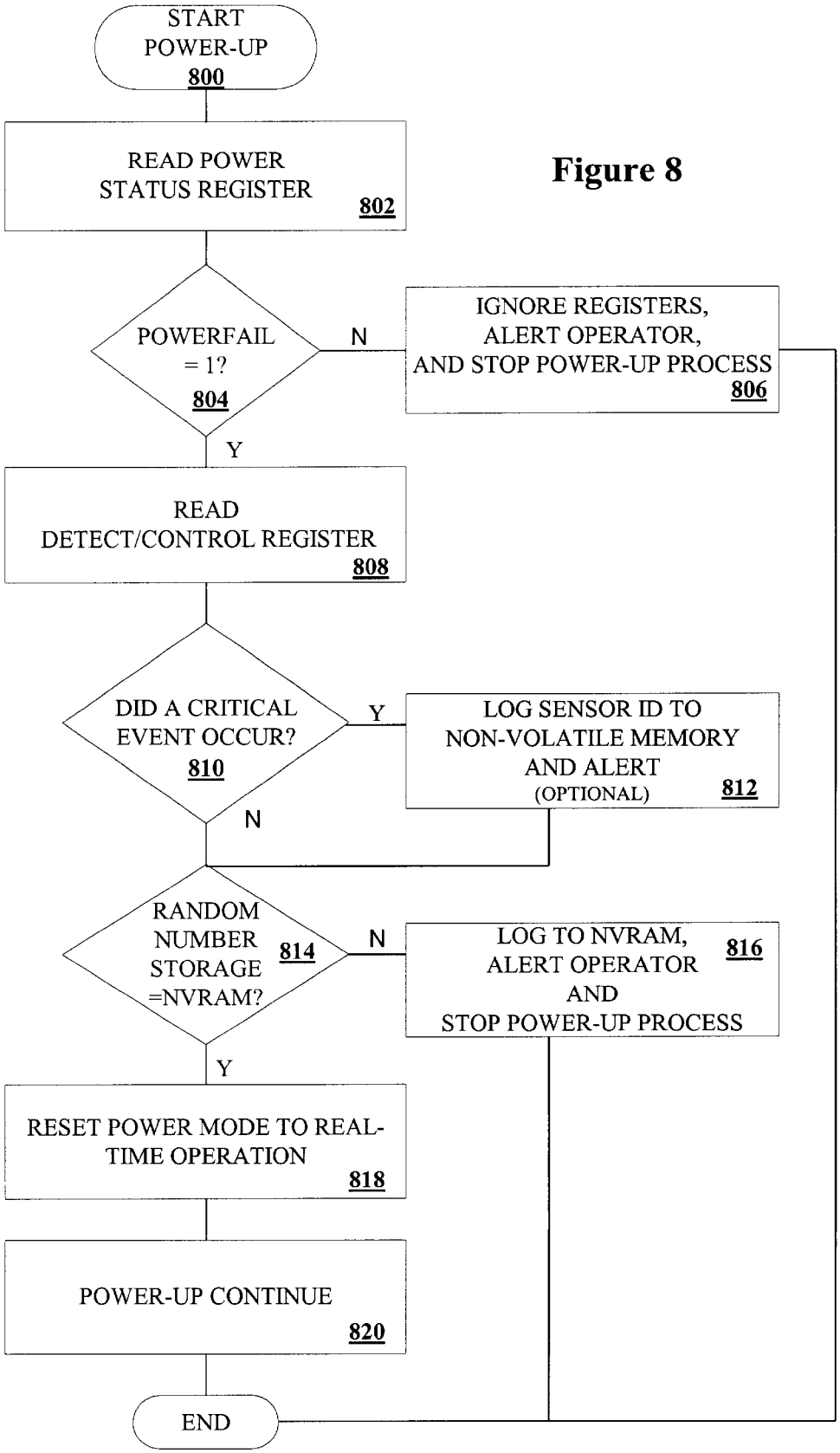
FIG. 8 is a flow diagram depicting the details of a power-up process involving the battery powered security monitoring system provided for one embodiment of this invention.

FIG. 8 is a flow diagram depicting the details of a power-up process involving the battery powered security monitoring system. A power-up to the gaming machine and the security monitoring system may be the result of a number of events including a power failure, maintenance to the gaming machine, or shipping of the gaming machine. For security purposes, when the gaming machine is not under outside power, the battery powered sensor monitoring system may attempt to detect binary events including open or closed doors within the gaming machine by monitoring sensors connected to various devices such as the doors. When power is restored to the gaming machine, the battery power to the sensor monitoring system may be switched off and the monitoring of the sensors may be performed by the sensor monitoring system in conjunction with software utilized by the gaming controller. FIG. 8 represents some of the steps the gaming machine may perform to transition the sensor monitoring system from a power-off state to a power-on state.

In FIG. 8, at some point after receiving power in step 800, the gaming controller in step 802 may read the power status register within the sensor monitoring circuitry shown in FIG. 5. In step 804, the gaming controller may check the value of the PowerFail bit described in FIG. 6. When the Powerfail bit=0, the gaming controller is executing the power-up procedure but a signal indicating a power failure or power difficulty was not stored in the Powerfail bit by the sensor monitoring circuitry. This situation may occur for a number of reasons. For example, an attempt may have been made to tamper with the sensor monitoring circuitry while the power was off or the sensor monitoring circuitry may have malfunctioned. Thus, when the Powerfail bit=0 during the power-up process, the gaming controller may ignore the rest of the registers in the sensor monitor circuitry, may stop the power-up process and may alert an attendant in step 806.

When the Powerfail bit=1, which indicates a power failure of some type may have occurred, the gaming controller reads the detection bits within the detect/control register and the power status register to determine whether any critical events have occurred including open doors, unlocked devices, or empty component slots, in step 804. These events may be indicated when the detection bit is either a 1 or 0. As an example, a critical event may have occurred when any of the detection bit registers contain a value of 1. When the gaming controller detects a critical event, information about the event, including which device may have experience an event, may be logged to non-volatile memory and an attendant may be alerted, in step 812.

When the detection bits for all of the devices indicate that no critical events have occurred, the random number storage register, described in FIG. 6, is sampled in step 814. As an extra security feature, the values in the random number storage register are compared with values stored in another non-volatile memory register located somewhere else in the gaming machine. When the security monitoring system is initialize, identical values are stored in the random number storage register and in the other non-volatile memory location. When a critical event occurs and this event is detected by the sensor monitoring circuitry, the random number storage register may be cleared so that the values in the random storage register and the other non-volatile memory differ. When no critical events were detected in step 810 but values in the random storage register and the non-volatile memory differ in step 814, an attempt to tamper with the gaming machine or some other malfunction may have occurred. In this case, the event may be logged to non-volatile memory and the power-up process may be halted in step 816. When the gaming controller has determined that no critical events have occurred when the power was off in steps 804, 810, and 814, the gaming controller writes an instruction to the detect/control register described in FIG. 6 and the security monitoring system is switched to real-time operation mode in step 818. After step 818, the gaming controller may continue other power-up procedures in step 820.

Figure 9:
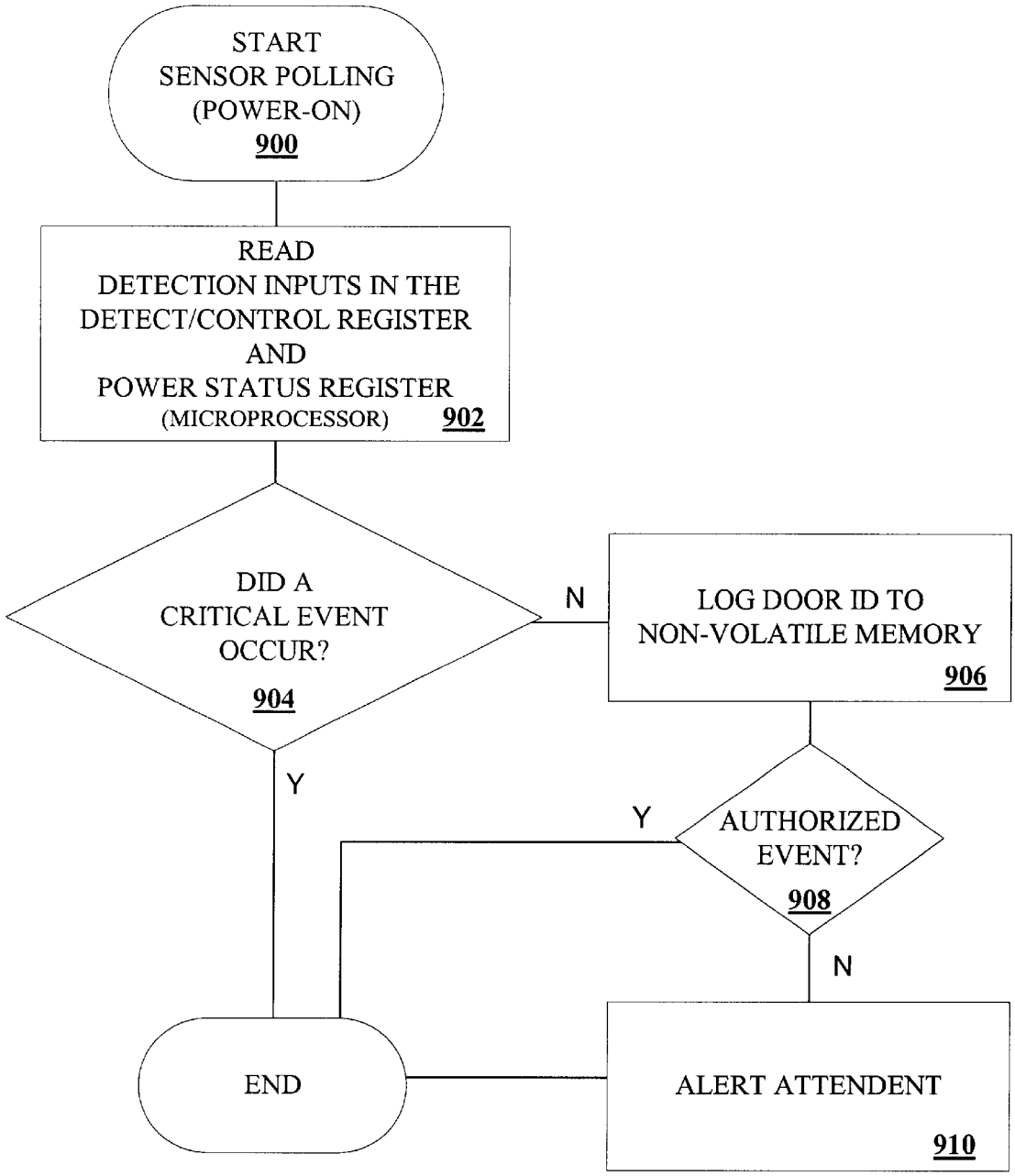
FIG. 9 is a flow diagram depicting the details of a door polling process involving the battery powered security monitoring system provided for one embodiment of this invention.

FIG. 9 is a flow diagram depicting the details of a sensor polling process involving the battery powered security monitoring system and the gaming controller for one embodiment of the present invention. When the gaming controller is receiving power from an outside, normally in step 900, the gaming controller will initiate a check of registers in the sensor monitoring circuitry to determine when a critical event has occurred. In step 902, the microprocessor on the gaming controller reads the values stored in the detect/control register and the power status register. In step 904, the value in the detection input bit for each sensor is compared to the value stored in the validation pulse bit to determine whether a critical event has occurred. As an example, the sensor monitoring circuitry may be designed so that a critical event including an open door or a compromised wire harness is indicated when the value of the detection input bit equals the value of the validation pulse level bit. When no critical events have been detected during a given time interval, the sensor polling process ends.

In step 906, when the gaming controller detects a critical event, information about the event, including the sensor ID, may be logged to non-volatile memory. In step 908, the gaming controller may check whether the event was authorized. For example, for planned maintenance of the gaming machine. When the event is authorized, the polling process ends. When the event is not authorized, in step 910, the gaming controller may alert an attendant.

Although the foregoing invention has been described in some detail for purposes of clarity of understanding, it will be apparent that certain changes and modifications may be practiced within the scope of the appended claims. For instance, while the gaming machines of this invention have been depicted as having accessible gaming devices physically attached to a main gaming machine cabinet, the use of gaming devices in accordance with this invention is not so limited. For example, the devices commonly provided on a top box may be included in a stand alone cabinet proximate to, but unconnected to, the main gaming machine chassis.

What is claimed is:

1. A custom integrated circuit for use in detecting access via one or more access mechanisms of a gaming machine having at least one sensor associated with each of the access mechanisms, each sensor having a sensor emitter and a sensor detector, the custom integrated circuit comprising:

(a) a source circuit providing an oscillating validation signal for controlling operation of the sensor emitter;

(b) a detection circuit for monitoring an output signal of the sensor detector by sampling the output signal at least twice within a single oscillation of the validation signal;

(c) comparison circuitry for comparing the values of the output signal sampled and the validation signal at particular times to determine when a first access mechanism has been actuated; and (d) a storage region for storing data indicating when access has been detected by the comparison circuitry (e) a random number storage register for storing a random number that is generated on the gaming machine and stored in the random number storage register and a second memory location on the gaming machine prior to actuation of the first access mechanism wherein the random number storage register is cleared when a first access mechanism has been actuated and wherein a comparison of a number stored in the random number storage register with the random number stored in the second memory location is used to determine when the first access mechanism has been actuated.

2. The custom integrated circuit of claim 1, further comprising a power connection allowing a battery to be coupled to the custom integrated circuit such that the battery can power the source circuit, the detection circuit, and the comparison circuitry.

3. The custom integrated circuit of claim 1, wherein the storage region includes a random number storage region for storing at least one random number.

4. The custom integrated circuit of claim 1, further comprising a power status storage region for storing signals on the operational status of one or more power sources including a main power supply and a battery for powering the sensor.

5. The custom integrated circuit of claim 1, wherein the integrated circuit is either a programmable logic device, a field programmable gate array, or an application specific integrated circuit.

6. The custom integrated circuit of claim 1, further comprising a connection to a master clock which provides a timing signal with a frequency of 30 Hz or greater.

7. The custom integrated circuit of claim 1, further comprising a connection allowing a device external to the custom integrated circuit to read the contents of the storage region.

8. The custom integrated circuit of claim 1, wherein the comparison circuitry compares the validation signal with the output signal from at least 7 sensors.

9. A method of monitoring an access mechanism allowing access to one or more gaming devices within a gaming machine using a sensor including sensor emitter and sensor detector that provides an output signal indicating whether the access mechanism has allowed access, the method comprising:

sending an oscillating validation signal to the sensor emitter, the validation signal controlling generation of an emitter signal at the sensor;

detecting the output signal from the sensor detector;

comparing the value of the validation signal and the value of the output signal at least twice during a single oscillation; and indicating access to the gaming machine when compared values of the validation signal and the output signal show that access to the gaming machine feature has occurred wherein the validation signal contains an on portion that turns on the sensor emitter and an off portion that turns off the emitter, and wherein the off portion lasts for a greater length of time than the on portion.

10. The method of claim 9, further comprising storing to a memory device a power signal indicating whether the gaming machine is using normal power or backup power.

11. The method of claim 9, wherein the method is implemented on a custom integrated circuit.

12. The method of claim 11, wherein indicating access comprises storing a signal indicating that access to the access mechanism has occurred, wherein the signal is stored in a non-volatile memory located on the custom integrated circuit.

13. The method of claim 9, wherein the custom integrated circuit is a custom integrated circuit that is a programmable logic device, a field programmable gate array, or an application specific integrated circuit.

14. The method of claim 9, further comprising:

storing an identical random string of numbers to two non-volatile memory locations within the gaming machine when main power is on to the gaining machine; and clearing the random number located within one of the non-volatile memory locations when access to one or more specified access mechanisms has occurred while main power is off.

15. The method of claim 9, further comprising:

determining that primary power to the gaming machine is off; and powering the sensor with battery power.

16. The method of claim 15, further comprising storing a power signal in memory, the power signal indicating that primary power to the gaming machine is off, wherein determining that primary power to the gaming machine is off comprises evaluating the power signal in memory.

17. The method of claim 9, further comprising:

monitoring a voltage level in a battery; and clearing a battery status indicator stored in a non-volatile memory located on a custom integrated circuit when the battery voltage is below a defined level.

18. The method of claim 9, wherein the validation signal has a frequency of at least about 30 Hz.

19. The method of claim 9, further comprising inverting the validation signal prior to transmitting it to the sensor emitter, wherein a normal access state is represented by opposite values of the validation signal and to output signal.

20. The method of claim 9, wherein the sensor is an optical sensor, a magnetic sensor or a mechanical sensor.

21. The method of claim 9, wherein the access mechanism is a lock, a wire, a retaining latch or a device receptor.

22. The method of claim 9, wherein the access mechanism provides access to a door selected from the group consisting of a main door, a bill stacker door, a CPU security door, a belly door, a drop door, a coupon dispenser door, a printer access door, a top box access door, a token dispenser door.

23. A method of monitoring an access mechanism allowing access to one or more gaming devices within a gaming machine using a sensor including sensor emitter and sensor detector that provides an output signal indicating whether the access mechanism has allowed access, the method comprising:

sending an oscillating validation signal to the sensor emitter, the validation signal controlling generation of an emitter signal at the sensor;

detecting the output signal from the sensor detector;

comparing the value of the validation signal and the value of the output signal at least twice during a single oscillation; and indicating access to the gaming machine when compared values of the validation signal and the output signal show that access to the gaming machine feature has occurred storing an identical random string of numbers to two non-volatile memory locations within the gaming machine when main power is on to the gaming machine; and clearing the random number located within one of the non-volatile memory locations when access to one or more specified access mechanisms has occurred while main power is off.

24. A method of monitoring an access mechanism allowing access to one or more gaming devices within a gaming machine using a sensor including sensor emitter and sensor detector that provides an output signal indicating whether the access mechanism has allowed access, the method comprising:

sending an oscillating validation signal to the sensor emitter, the validation signal controlling generation of an emitter signal at the sensor;

detecting the output signal from the sensor detector, comparing the value of the validation signal and the value of the output signal at least twice during a single oscillation; and indicating access to the gaming machine when compared values of the validation signal and the output signal show that access to the gaming machine feature has occurred determining that primary power to the gaming machine is off;

powering the sensor with battery power; and storing a power signal in memory, the power signal indicating that primary power to the gaming machine is off, wherein determining that primary power to the gaming machine is off comprises evaluating the power signal in memory.

25. A method of monitoring an access mechanism allowing access to one or more gaming devices within a gaming machine using a sensor including sensor emitter and sensor detector that provides an output signal indicating whether the access mechanism has allowed access, the method comprising;

sending an oscillating validation signal to the sensor emitter, the validation signal controlling generation of an emitter signal at the sensor;

detecting the output signal from the sensor detector;

comparing the value of the validation signal and the value of the output signal at least twice during a single oscillation; and indicating access to the gaming machine when compared values of the validation signal and the output signal show that access to the gaming machine feature has occurred monitoring a voltage level in a battery; and clearing a battery status indicator stored in a non-volatile memory located on a custom integrated circuit when the battery voltage is below a defined level.

26. A custom integrated circuit for use in detecting access via one or more access mechanisms of a gaming machine having at least one sensor associated with each of the access mechanisms, each sensor having a sensor emitter and a sensor detector, the custom integrated circuit comprising:

(a) a source circuit providing an oscillating validation signal for controlling operation of the sensor emitter;

(b) a detection circuit for monitoring an output signal of the sensor detector by sampling the output signal at least twice within a single oscillation of the validation signal;

(c) comparison circuitry for comparing the values of the output signal sampled and the validation signal at least twice during a single oscillation to determine when a first access mechanism has been actuated;

(d) a storage region for storing data indicating when access has been detected by the comparison circuitry; and (e) battery monitoring circuitry for monitoring a voltage level in a battery and for clearing a battery status indicator stored in a non-volatile memory in the storage region when the battery voltage level is below a defined level.

27. A custom integrated circuit for use in detecting access via one or more access mechanisms of a gaming machine having at least one sensor associated with each of the access mechanisms, each sensor having a sensor emitter and a sensor detector, the custom integrated circuit comprising:

(a) a source circuit providing an oscillating validation signal for controlling operation of the sensor emitter wherein the validation signal contains an on portion that turns on the sensor emitter and an off portion that turns off the emitter, and wherein the off portion lasts for a greater length of time than the on portion;

(b) a detection circuit for monitoring an output signal of the sensor detector by sampling the output signal at least twice within a single oscillation of the validation signal;

(c) comparison circuitry for comparing the values of the output signal sampled and the validation signal at least twice during a single oscillation to determine when a first access mechanism has been actuated;

(d) a storage region for storing data indicating when access has been detected by the comparison circuitry.

* * * * *

UNITED STATES PATENT AND TRADEMARK OFFICE

CERTIFICATE OF CORRECTION

PATENT NO. : 6,773,348 B2
DATED : August 10, 2004
INVENTOR(S) : James W. Stockdale It is certified that error appears in the above-identified patent and that said Letters Patent is hereby corrected as shown below:

Column 22,
Line 14, change "the gaming machine" to -- a gaming machine --
Line 37, change "gaining" to -- gaming --

Column 23,
Line 22, change "the gaming machine" to -- a gaming machine --

Column 24,
Line 11, change "the gaming machine" to -- a gaming machine --

Signed and Sealed this

Eighteenth Day of January, 2005

JON W. DUDAS
*Director of the United States Patent and Trademark Office*